US005983998A

United States Patent [19]

Kim

[11] Patent Number: 5,983,998

[45] Date of Patent: Nov. 16, 1999

[54] PIPE ARRANGEMENT IN AN EVAPORATOR OF AN AIR CONDITIONER

[75] Inventor: Dong-wug Kim, Pyungtaeg, Rep. of Korea

[73] Assignee: Samsung Electronics Co., Ltd., Kyungki-do, Rep. of Korea

[21] Appl. No.: 09/159,768

[22] Filed: Sep. 24, 1998

[30] Foreign Application Priority Data

Mar. 6, 1998 [KR] Rep. of Korea ..... P98-7426

[51] Int. Cl.[6] ..... F28D 1/04

[52] U.S. Cl. ..... 165/150; 62/519; 62/526; 165/122; 165/151

[58] Field of Search ..... 165/122, 53, 150, 165/151; 62/519, 526

[56] References Cited

U.S. PATENT DOCUMENTS

| | | | |
|---|---|---|---|
| 2,669,099 | 2/1954 | Malkoff | 62/526 |
| 4,265,093 | 5/1981 | Newton | 62/526 |
| 4,690,209 | 9/1987 | Martin | 165/150 |
| 5,076,353 | 12/1991 | Haussmann | 165/150 |
| 5,417,279 | 5/1995 | Wada | 165/150 |
| 5,613,554 | 3/1997 | Bull et al. | 165/150 |
| 5,660,056 | 8/1997 | Arai et al. | 165/122 |
| 5,758,719 | 6/1998 | Yoshihashi et al. | 165/122 |
| 5,896,921 | 4/1999 | Lee | 165/122 |

FOREIGN PATENT DOCUMENTS

| | | | |
|---|---|---|---|
| 2-52988 | 2/1990 | Japan | 165/150 |
| 2-223791 | 9/1990 | Japan | 165/150 |

*Primary Examiner*—Ira S. Lazarus
*Assistant Examiner*—Terrell McKinnon
*Attorney, Agent, or Firm*—Burns, Doane, Swecker & Mathis, L.L.P.

[57] ABSTRACT

An evaporator of an air conditioner has front and rear sections, and heat-exchanging pipes comprised of first, second, and third independent refrigerant passages. In the first passage, refrigerant enters a first row of a front line of the rear section, circulates completely through the rear section, and then exits from a second row of the front line of the rear section. In the second passage, refrigerant enters a first row of the front line of the front section, circulates through an upper portion of the front section, and then exits from a first row of the rear line of the front section. In the third passage refrigerant enters a fifth row of the front line of the front section, circulates through a lower portion of the front section, and then exits from a seventh row of the rear line of the front section.

2 Claims, 2 Drawing Sheets

PIPE ARRANGEMENT IN AN EVAPORATOR OF AN AIR CONDITIONER

BACKGROUND OF THE INVENTION

1. Field of the Invention

The present invention relates to a separate type air conditioner which has an evaporator as an indoor heat exchanger and a condenser as an outdoor heat exchanger.

2. Description of the Prior Art

Generally, an air conditioner is an appliance for maintaining optimum temperature conditions in a room. Particularly, temperature is adjusted to a proper degree by exhausting heat out of the room by means of a refrigerant cycle.

As shown in FIG. 1, a refrigerant cycle comprises a compressor 2 for compressing refrigerant into a high temperature and high pressure, a condenser 3 serving as an outside heat exchanger for liquefying the high temperature and high pressure refrigerant into a normal temperature and high pressure, a capillary tube 4 for depressurizing refrigerant, and an evaporator 1 for lowering the temperature in the room by exchanging heat of the air in the room with the refrigerant received from the capillary tube 4. Additionally, blowing fans 5 and 6 for enhancing the efficiency of the heat exchange are installed on the condenser 3, and the compressor 1, respectively.

Particulary, the evaporator 1 consists of a plurality of fins A arranged close to each other and a plurality of U-shaped heat-exchanging pipes B passing through the fins A.

These heat-exchanging pipes B constitute a refrigerant circulating passage. The heat exchanging pipes B are interconnected by connecting pipes C which connect the ends of respective heat-exchanging pipes B with each other.

The manner of aligning these heat-exchanging pipes B seriously affects the quality of the evaporator 1. Therefore, there have been many experiments and studies about how to make a good arrangement of heat-exchanging pipes B so as to improve quality of the evaporator 1.

A prior art arrangement of the heat-exchanging pipes B of the evaporator 1 is shown in FIG. 2 in greater detail. What is shown in FIG. 2 is the pipe arrangement of the evaporator 1 of a separate air conditioner having the evaporator 1 and the condenser 3, each of which being installed as a separate unit.

As shown, the evaporator 1 is divided into a front section 10 and a rear section 20. The heat-exchanging pipes B installed on the front section 10 and the rear section 20 are respectively aligned in two lines, i.e., a front line (11-1, 11-2, . . . , 11-10 in the front section 10, and a front line 21-1, 21-2 . . . , 22-5 of the rear section 20) and a rear line (12-1, 12-2, . . . , 12-10 of the front section 10, and a rear line 22-1, 22-2, . . . , 22-5 of the rear section 20). Shown in solid lines are connecting pipes C for connecting the ends of respective heat-exchanging pipes B with each other, and shown in dotted lines are connecting portions of respective heat-exchanging pipes B. The connecting portions are positioned at a side of the fins A opposite to the connecting pipes C.

Thus, the refrigerant which has passed through the capillary tube 4 is introduced into a 4-gate distributor 7' and divided into four passages, that is a first passage, a second passage, a third passage, and a fourth passage. In the first passage, refrigerant enters into 22-2, passes through 22-3, 22-4, 22-5, 21-5, 21-4, 21-3, and exits from 21-2. In the second passage, refrigerant enters into 22-1, and passes through 21-1, 11-1, 11-2, 11-3, 12-3, 12-2, then exits from 12-1. Refrigerant enters into 11-8 and passes through 11-7, 11-6, 11-5, 11-4, 12-4, and 12-5, then exits from 12-6 in the third passage. Lastly, in the fourth passage, refrigerant enters into 11-9, passes through 11-10, 12-10, 12-9, 12-8, and exits from 12-7. While the refrigerant flows through the four passages, it is evaporated to cool the air around the evaporator 1, and then it is converged in a 4-gate connecter 8' to flow to the compressor (not shown).

The above described arrangement of the heat-exchanging pipes B of the evaporator 1 makes the evaporation process successful without a pressure loss of refrigerant passing through the heat-exchanging pipes B.

According to the conventional manner in which the heat-exchanging pipes B of the evaporator 1 are arranged, however, there are great differences in the temperature of refrigerant from one refrigerant passages to the other. Moreover, temperature differences also occur between the parts of each passage, i.e, inlet part, middle part, and outlet part thereof. Specifically, it has turned out that the temperature ranges from 4.9° C. to 16.8° C., of which a maximum difference is 11.9° C.

As the temperature difference of refrigerant is great between the passages and the parts of a passage, there is a serious drawback in the performance of the evaporator 1. Also, some of the refrigerant passing through the evaporator 1 does not evaporate and remains in a liquid state, or turns to a frozen state.

SUMMARY OF THE INVENTION

An object of the present invention is to provide an evaporator of a separate type air conditioner which has a heat-exchanging pipe arranged in such a manner that refrigerant has a more uniform temperature in passages or pipes, and thereby has a substantially improved efficiency and performance.

The above object is accomplished by an evaporator of a separate type air conditioner comprising: a front section having a plurality of fins aligned in parallel and close to each other, and first heat-exchanging pipes which are U-shaped and pass through said fins, said first heat-exchanging pipes forming a front line of ten front rows and a rear line of ten rear rows; a rear section being placed at a rear side of said front section, said rear section having a plurality of fins aligned in parallel close to each other, and second heat-exchanging pipes-which are U-shaped and pass through said fins, said second heat exchanging pipes forming a front line of five front rows and a rear line of five rear rows; and a plurality of connecting pipes for connecting ends of said heat-exchanging pipes of said front section and said rear section, wherein said first and second heat-exchanging pipes and said connecting pipes are connected with each other so as to constitute a refrigerant circulation passage comprising: a first passage in which a refrigerant enters a first row of said front line of said rear section, circulates through said front and rear lines of said rear section, and then exits from a second row of the front line of said rear section; a second passage in which refrigerant enters a first row of said front line of said front section, circulates through all upper portion of said front section, and then exits from a first row of said rear line of said front section; and a third passage in which refrigerant enters a fifth row of said front line of said front section, circulates through a lower portion of said front section, and then exits from a seventh row of said rear line of said front section.

According to the present invention, the temperature of the refrigerant circulated through the heat-exchanging pipes can be maintained uniform regardless of the place where the refrigerant passes. Accordingly, evaporation efficiency and heat exchange performance substantially increases.

BRIEF DESCRIPTION OF THE DRAWINGS

The above object and advantages will be more apparent by describing preferred embodiment in greater detail with reference to the drawings accompanied, in which.

DETAILED DESCRIPTION OF THE PREFERRED EMBODIMENT

Figure 1:
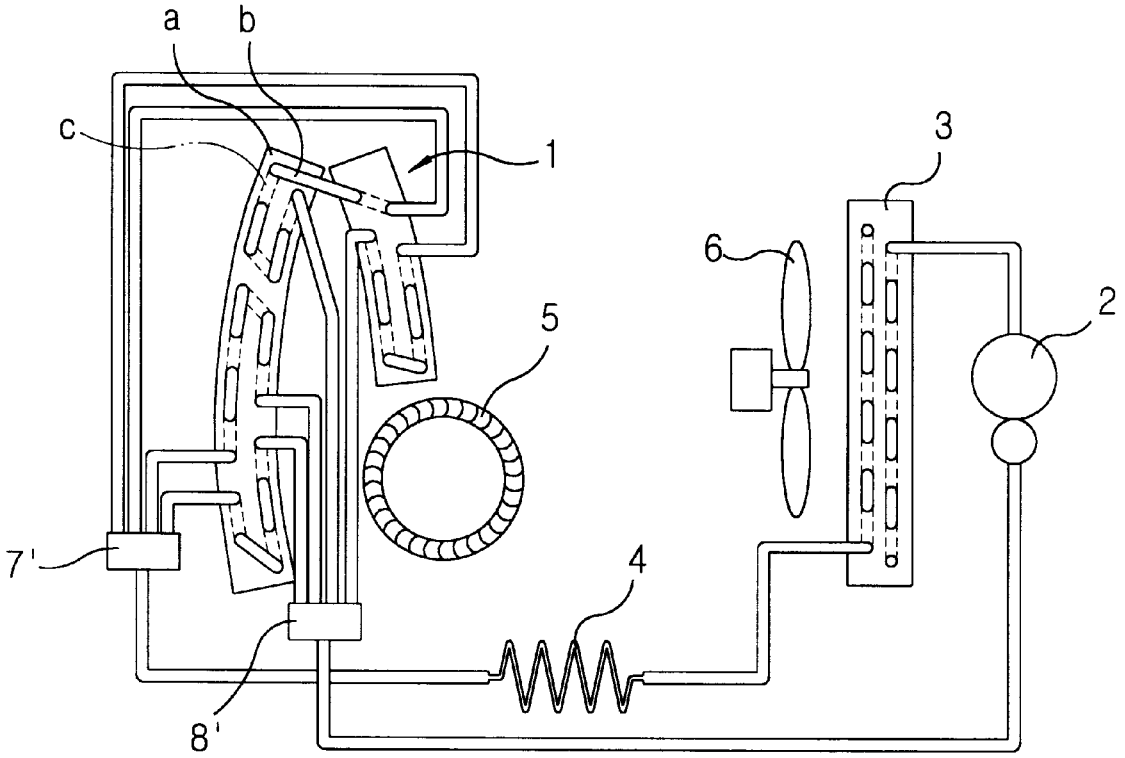
FIG. 1 (PRIOR ART)
FIG. 1 is a schematic view showing a construction of a refrigerant cycle in a prior art air conditioner.
Figure 2:
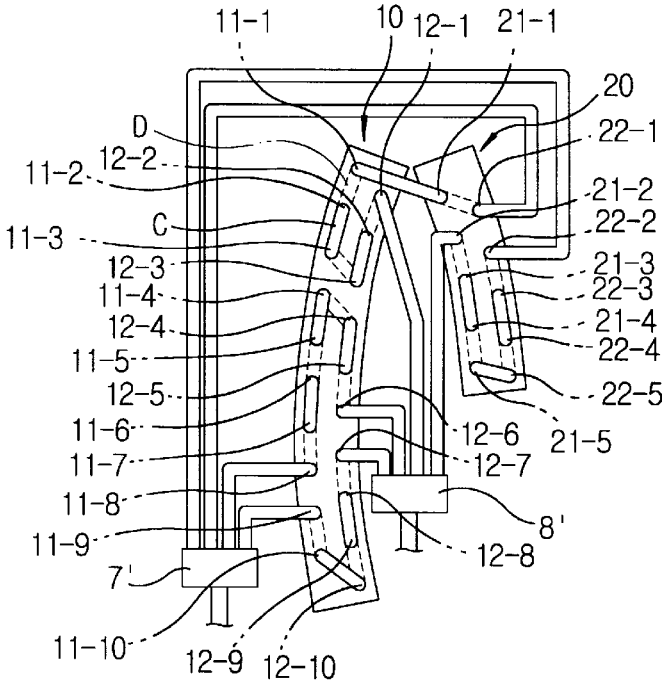
FIG. 2 (PRIOR ART)
FIG. 2 is a schematic side view showing an alignment of heat-exchanging pipes in an evaporator of the conventional separate type air conditioner.
Figure 3:
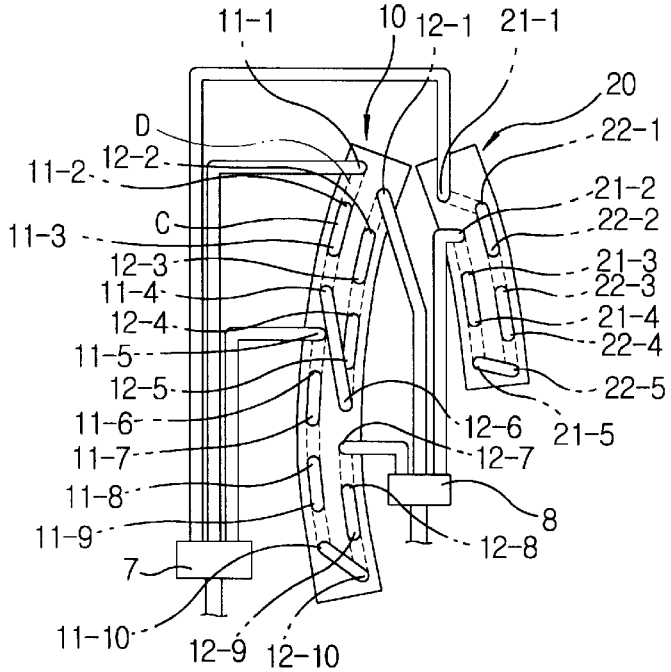
FIG. 3 is a schematic side view showing an alignment of heat-exchanging pipes in an evaporator of a separate type air conditioner according to the present invention.

An evaporator of a separate type air conditioner according to the present invention is shown in FIG. 3.

As shown, the evaporator 100 according to the present invention is divided into a front section 10 and a rear section 20. Each of the front section 10 and the rear section 20 is comprised of a plurality of fins A aligned in parallel close to each other, and a plurality of U-shaped heat-exchanging pipes B passing through the fins A.

Respective openings of the heat-exchanging pipes B are linked by a plurality of connecting pipes C which are U-shaped, too.

The heat-exchanging pipes B installed at the front section 10 are aligned defining ten rows thereof. Here, the first row of the front line is designated with a reference numeral 11-1, a second row of the front line is 11-2, a first row of the rear line is 12-1, a tenth row of the rear line is 12-10, and so on.

The heat-exchanging pipes B installed at the rear section 20 are aligned in the same manner with that of the front section 10, however, there is a difference in that the heat-exchanging pipes B of the rear section 20 are aligned defining five rows thereof. In the rear section 20, the first row of the front line is designated with the reference numeral 21-1, the second row of the front line is 21-2, the first row of the rear line is 22-1, the fifth row of the rear line is 22-5, and so on.

Hereinafter described is the refrigerant circulation passage of tile evaporator 1 according to the present invention.

The refrigerant circulation passage of the evaporator 1 according to the present invention is divided into a first passage wherein the refrigerant is circulated through the rear section, a second passage wherein the refrigerant is circulated through an upper portion of the front section, and a third passage wherein the refrigerant is circulated through a lower portion of the front section.

More specifically, the refrigerant passing through the capillary tube (not shown) and flowing into the evaporator 1 is divided into three passages by a 3-gate distributor 7 installed at an inlet portion of the evaporator 1. The refrigerant, divided into three branches, is circulated as follows. First, the refrigerant enters the first row 21-1 of the front line of the rear section 20 and exits from the second row 21-2 of the front line of the rear section 20 (the first passage). Second, the refrigerant enters the first row 11-1 of the front line of the front section 10 and exits from the first row 12-1 of the rear line of the front section 10 (the second passage). Third, the refrigerant enters the fifth row 11-5 of the front line of the front section 10 and exits from the seventh row 12-7 of the rear line of the front section (the third passage). The refrigerant exiting from the outlet portions of the heat-exchanging pipes is converged into the three-gate connector 8 and is introduced into a compressor (not shown) installed at the outdoor unit.

More specifically, the first passage starts from the first row of the front line of the rear section 20, i.e, 21-1, goes on through 22-1, 22-2, 22-3, 22-4, 22-5, 21-5, 21-4, 21-3, and then is connected to the second row of the front line of the rear section 20, i.e., 21-2 which is connected to the 3-gate connector 8.

The second passage starts from the first row of the front line of the front section 10, i.e., 11-1, goes on through 11-2, 11-3, 11-4, 12-6, 12-5, 12-4, 12-3, 12-2, and then is connected to the first row of the rear line of the front section 10, i.e., 12-1 which is connected to the 3-gate connector 8.

The third passage starts from the fifth row of the front line of the front section 10, i.e., 11-5, goes on through 11-6, 11-7, 11-8, 11-9, 11-10, 12-10, 12-9, 12-8, and then is connected to the seventh row of the rear line of the front section 10, i.e., 12-7 which is connected to the 3-gate connector 8.

A test result of the distribution of the temperature of the refrigerant in each position of the heat-exchanging pipes B of the evaporator 1 according to the present invention and the conventional art is shown in table 1 below.

TABLE 1

| Items | | Measuring unit | Prior art | Present invention |
|---|---|---|---|---|
| Cooling capacity | | kcal/hr | 2,914 | 3,302 |
| | | % | 82.1 | 93.0 |
| E.E.R | | Kcal/hr w | 2.408 | 2.653 |
| Power input | | W | 1,210 | 1,245 |
| First passage | Inlet | ° C. | 5.9 | 11.3 |
| | Middle Section | ° C. | 9.9 | 11.3 |
| | Outlet | ° C. | 11.5 | 9.9 |
| Second passage | Inlet | ° C. | 6.1 | 11.7 |
| | Middle Section | ° C. | 14.2 | 11.6 |
| | Outlet | ° C. | 16.4 | 9.8 |
| Third passage | Inlet | ° C. | 5.9 | 11.5 |
| | Middle Section | ° C. | 16.8 | 12.2 |
| | Outlet | ° C. | 11.0 | 15.7 |
| Fourth passage | Inlet | ° C. | 5.3 | — |
| | Middle Section | ° C. | 5.6 | — |
| | Outlet | ° C. | 4.9 | — |

According to Table 1, the temperature of the refrigerant in the conventional evaporator varies from 4.9° C. to 16.8° C., which is a great deviation of temperature. Comparatively, in the evaporator according to the present invention, the temperature of the refrigerant varies from 9.8° C. to 15.7° C., which is a small deviation of temperature in comparison with the conventional art. Thus, it is apparent that the evaporator according to the present invention has a more uniform distribution of temperature of the refrigerant therein.

Further, as the temperature becomes uniform, the cooling capacity of the evaporator according to the present invention also increases approximately by 8.9%, and the efficiency thereof increases by 10.1%.

As described, according to the present invention, since the refrigerant temperature becomes uniform regardless of the place the refrigerant is passing, the evaporation efficiency and performance increase greatly.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. An evaporator of an air conditioner comprising:

a front section having a plurality of fins aligned in parallel close to each other, and first heat-exchanging pipes which are U-shaped and pass through said fins, said first heat exchanging pipes forming a front line of ten front rows and a rear line of ten rear rows;

a rear section disposed at a rear side of said front section, said rear section having a plurality of fins aligned in parallel close to each other, and second heat-exchanging pipes which are U-shaped and pass through said fins, said second heat exchanging pipes forming a front line of five front rows and a rear line of five rear rows; and a plurality of connecting pipes for connecting ends of said heat-exchanging pipes of said front section and said rear section, wherein said heat-exchanging pipes and said connecting pipes are connected with each other so as to constitute a refrigerant circulation passage comprising:

a first passage in which refrigerant enters a first row of said front line of said rear section, circulates through said front and rear lines of said rear section, and then exits from a second row of said front line of said rear section;

a second passage in which refrigerant enters a first row of said front line of said front section, circulates through an upper portion of said front section, and then exits from a first row of said rear line of said front section; and a third passage in which refrigerant enters a fifth row of said front line of said front section, circulates through a lower portion of said front section, and then exits from a fifth row of said rear line of said front section.

2. The evaporator as claimed in claim 1, wherein said first passage starts from said first row of said front line of said rear section, goes on through: a first row of said rear line, a second row of said rear line, a third row of said rear line, a fourth row of said rear line, a fifth row of said rear line, a fifth row of said front line, a fourth row of said front line, a third row of said front line, and is connected to a second row of said front line;

said second passage starts from said first row of said front line of said front section, goes on through: second, third and fourth rows of said front line, a sixth row of said rear line, a fifth row of said rear line, a fourth row of said rear line, the third row of said rear line, a second row of said rear line, and is connected to said first row of said rear line; and said third passage starts from said fifth row of said front line of said front section, goes on through: a sixth row of said front line, a seventh row of said front line, eight, ninth, and tenth rows of said front line, a tenth row of the rear line, a ninth row of said rear line, an eighth row of said rear line, and is connected to a ninth row of said rear line.

* * * * *